US005272043A

United States Patent [19]

Begley et al.

[11] Patent Number: 5,272,043

[45] Date of Patent: * Dec. 21, 1993

[54] PHOTOGRAPHIC MATERIAL AND PROCESS COMPRISING DIR COUPLER

[75] Inventors: William J. Begley, Webster; Hans G. Ling, Rochester, both of N.Y.

[73] Assignee: Eastman Kodak Company, Rochester, N.Y.

[ * ] Notice: The portion of the term of this patent subsequent to Sep. 29, 2009 has been disclaimed.

[21] Appl. No.: 724,553

[22] Filed: Jun. 28, 1991

[51] Int. Cl.[5] ..... G03C 7/34; G03C 7/36

[52] U.S. Cl. ..... 430/382; 430/544; 430/553; 430/557; 430/957

[58] Field of Search ..... 430/544, 957, 382, 543, 430/553, 557

[56] References Cited

U.S. PATENT DOCUMENTS

| | | | |
|---|---|---|---|
| 4,482,629 | 11/1984 | Nakagawa et al. | 430/544 |
| 4,760,016 | 7/1988 | Hirabayashi et al. | 430/544 |
| 4,782,012 | 11/1988 | De Selms et al. | 430/544 |
| 4,818,670 | 4/1989 | Yagi et al. | 430/544 |
| 4,861,701 | 8/1989 | Burns et al. | 430/544 |
| 5,026,628 | 6/1991 | Begley et al. | 430/544 |
| 5,126,236 | 6/1992 | Mihayashi et al. | 430/544 |
| 5,151,343 | 9/1992 | Begley et al. | 430/544 |

OTHER PUBLICATIONS

"Photographic . . . Systems", *Research Disclosure* No. 308119, Dec. 1989.

Chem. Abstr. 107:67984v; 1987, Abstr. of Japanese Kokai 61/255,342 (Nov. 13, 1986).

*Primary Examiner*—Richard L. Schilling

*Attorney, Agent, or Firm*—Richard E. Knapp

[57] ABSTRACT

A photographic DIR (development inhibitor-releasing) acetanilide coupler containing a carboxy group on the anilide moiety or a DIR naphtholic coupler containing on the 2-position a —$CONH_2$ or —$CONHCH_3$ group, capable upon oxidative coupling of forming a dye capable of being washed out of a photographic element upon processing, contains, in the coupling position, a coupling-off group comprising, in sequence, at least one ballasted linking group and at least one releasable development-inhibitor group (INH) which is a mercaptotetrazole group which enables a Log P in a pH 10 buffer of lower than −0.8. Such a DIR coupler is especially useful in a color photographic silver halide material and process which enables the dye formed from the DIR coupler to be washed out of the photographic material upon processing and enhanced color saturation through interimage effects.

12 Claims, No Drawings

PHOTOGRAPHIC MATERIAL AND PROCESS COMPRISING DIR COUPLER

This invention relates to a photographic DIR (development inhibitor-releasing) acetanilide or naphtholic coupler capable upon oxidative coupling of forming a dye which is capable of being washed out of the photographic material containing the coupler upon processing and to photographic materials and processes comprising such a DIR coupler.

Various couplers are known in photographic materials and processes. Classes of photographic couplers include acetanilide and naphtholic couplers which typically form dyes upon oxidative coupling in photographic materials and processes. The acetanilide couplers typically form yellow dyes and the naphtholic couplers typically form cyan dyes upon oxidative coupling with color-developing agents. Such couplers are also known which are capable of forming dyes upon oxidative coupling which can be washed out of the photographic material upon processing. These couplers are described in, for example, U.S. Pat. No. 4,482,629.

The couplers capable of forming dyes which can be washed out of the photographic material upon photographic processing contain a water-solubilizing group such as a carboxy group or sulfonic acid group. It has been desirable to provide such a coupler which is not as expensive to manufacture as the described couplers and still provides a useful dye which can be washed out of the photographic material with the added advantage that the coupler enables a lower concentration of coupler to be used in a photographic element.

It has also been desirable to provide such a coupler which contains a coupling-off group which enables desired acutance and desired interimage effects in a color photographic silver halide material and process at lower concentrations of coupler.

The present invention solves these problems by providing a photographic element comprising a support bearing at least one photographic silver halide emulsion layer in association with at least one DIR (development inhibitor-releasing) coupler containing a solubilizing group which enables the coupler upon oxidative coupling to form a dye capable of being washed out of the element upon processing and in the coupling position a coupling-off group comprising at least one releasable mobile development-inhibitor moiety; wherein the development inhibitor-releasing coupler is (a) an acetanilide coupler containing a carboxy group on the acetanilide group or (b) a naphtholic coupler containing in the 2-position a —$CONH_2$ or —$CONHCH_3$ group; and contains in the coupling position a coupling-off group comprising in sequence at least one ballasted linking group and at least one releasable development inhibitor group that is a mercaptotetrazole group which enables a Log P in a pH 10 buffer than −0.8.

The DIR coupler as described can be represented by the formula:

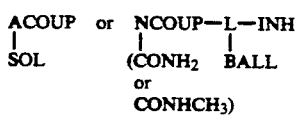

wherein:

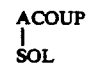

is an acetanilide dye-forming coupler moiety;

SOL is a carboxy group on the acetanilide group of the dye-forming coupler moiety;

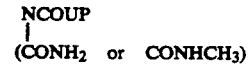

is a naphtholic dye-forming coupler moiety containing —$CONH_2$ or $CONHCH_3$ in the 2-position of the coupler moiety;

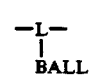

is a releasable ballasted linking group, bonded to the coupling position of

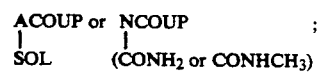

BALL is a ballast group which, with the remainder of the coupler, enables the DIR coupler to be immobile prior to exposure and processing of the photographic element;

INH is a mercaptotetrazole group which enables a Log P in a pH 10 buffer of lower than −0.8.

The acetanilide dye-forming coupler moiety containing the solubilizing group (SOL) can be any such acetanilide dye-forming coupler moiety known in the photographic art. The acetanilide dye-forming coupler moiety is typically a benzoylacetanilide or pivalylacetanilide coupler moiety. Examples of such acetanilide couplers are represented by the formulas:

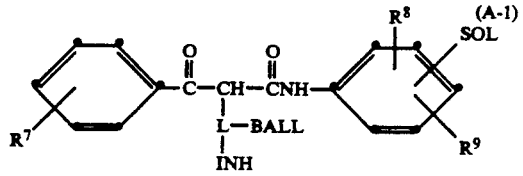

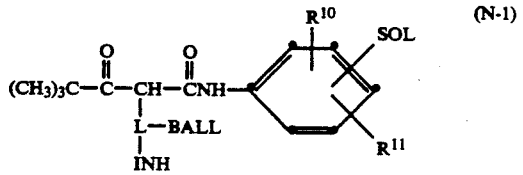

wherein $R^7$ is hydrogen, one or more halogen such as chlorine or bromine; alkyl containing 1 to 4 carbon natoms such as methyl, ethyl, n-propyl, i-propyl, n-butyl or t-butyl; or alkoxy containing 1 to 4 carbon atoms such as methoxy, ethoxy, propoxy, n-butoxy or t-butoxy;

$R^8$ and $R^{10}$ individually are hydrogen; one or more halogen such as chlorine or bromine; alkyl containing 1 to 4 carbon atoms such as methyl, ethyl, i-propyl, n-propyl, i-butyl, n-butyl or t-butyl; or alkoxy containing 1 to 4 carbon atoms such as methoxy, ethoxy, n-propyl, n-butyl, i-butyl or t-butyl;

$R^9$ and $R^{11}$ individually are hydrogen or a substituent which does not adversely affect the coupling reaction and does not prevent formation of a dye capable of being washed out of the photographic element upon processing, such as alkyl containing 1 to 4 carbon atoms such as methyl or ethyl, alkoxy containing 1 to 4 carbon atoms such as methoxy or ethoxy, or halogen such as chlorine or bromine;

SOL is a water-solubilizing group which enables the dye formed upon oxidative coupling of the coupler to be washed out of the photographic element upon processing, especially a carboxy group;

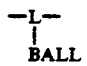

is any ballasted link group which is releasable upon oxidative coupling from the coupler; and BALL is a ballast group which enables the DIR coupler to be immobile in the photographic element prior to exposure and processing.

Examples of the described naphtholic couplers are represented by the formula:

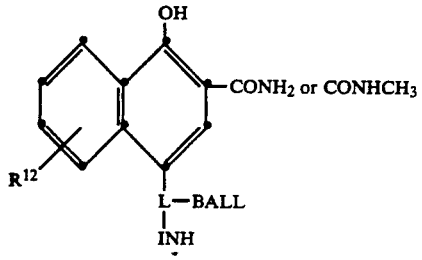

wherein: $R^{12}$ is hydrogen or at least one substituent which does not adversely affect the coupling action or the formation of a dye capable of being washed out of the photographic element upon processing, for example, alkyl containing 1 to 4 carbon atoms such as methyl, ethyl, n-propyl, n-butyl or t-butyl; alkoxy containing 1 to 4 carbon atoms such as methoxy and ethoxy; amide groups, such as $NHCOCH_3$; sulfonamide, such as $NHSO_2CH_3$; sulfamyl groups, such as $SO_2NHCH_3$; carbamyl groups, such as $CONHCH_3$; and

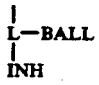

is as described above.

The ballasted coupling-off group enables the coupler to be immobile in the photographic element prior to exposure and processing. Upon exposure and processing of the described element, the coupler reacts with oxidized color-developing agent to form a dye which is washes out of the element during processing. Also, the coupling-off group is released during processing. The portion of the coupling-off group containing the ballast group remains in the location in which it was coated. The inhibitor group (INH) is also released upon photographic processing. The inhibitor group is mobile to allow it, after release, to move to a location in the element at which it can serve its intended function.

A process of forming an image having the described advantages comprises developing an exposed photographic element as described by means of a color-developing agent in the presence of the described DIR coupler and washing out the dye formed from the DIR coupler.

It will be appreciated that, depending upon the particular developing agent and the particular type of processing, the reaction product of the coupler moiety and the oxidized developing agent can be colored or colorless.

The ballasted linking group can be any linking group known in the photographic art which can contain a ballast group.

The cleavage of the bond between the INH and the remainder of the coupling-off group can involve any reaction known in the photographic art for cleavage of such groups, for example, an intramolecular nucleophilic displacement reaction or other elimination reaction.

Any ballast group known in the photographic art can be useful on the coupling-off group. The ballast group (BALL) herein means an organic group of such size and configuration as to confer on the coupler molecule sufficient bulk to render the coupler substantially non-diffusible from the layer in which it is coated in a photographic element prior to exposure and processing. Representative ballast groups include substituted or unsubstituted alkyl or aryl groups containing, for example, 8 to 40 carbon atoms. Other useful ballast groups include sulfonamido groups containing 8 to 40 carbon atoms, carbonamido, carbamoyl, sulfamoyl, ester, sulfone, ether, thioether and amino groups.

Examples of ballast groups are $—NHSO_2C_{16}H_{33}$-n; $—SO_2NHC_{16}H_{33}$-n; $—NHCOC_{16}H_{33}$-n;

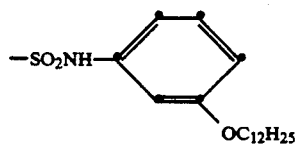

and

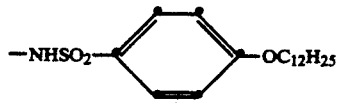

The ballasted linking group is, for example, preferably represented by the formula:

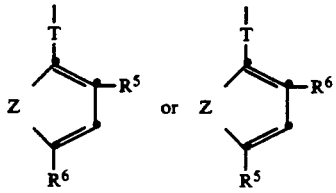

wherein:

$R^5$ is a ballast group known in the photographic art preferably one of the ballast groups as described;

$R^6$ is an unsubstituted or substituted methylene group bonded to the sulfur atom of the mercaptotetrazole development inhibitor;

T is O or S; and

Z represents the atoms completing a phenyl or naphthyl group or a heterocyclic group, such as a 5- or 6-member heterocyclic group, for example, a diazole group or imidazole group. The phenyl or naphthyl group, in addition to containing the ballast group, can be unsubstituted or substituted with other groups, such as $-NO_2$, $-NHCOR^7$, $-CONHR^7$, $-NHSO_2R^7$, $-SO_2NHR^7$, $-OR^7$, Cl, Br, $SO_2R^7$ or $CO_2R^7$, which do not adversely affect the photographic element or DIR coupler, wherein $R^7$ is unsubstituted or substituted alkyl or aryl.

Examples of useful ballasted linking groups are as follows:

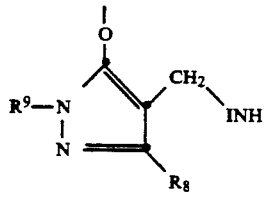

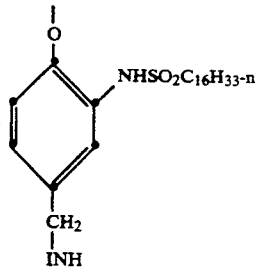

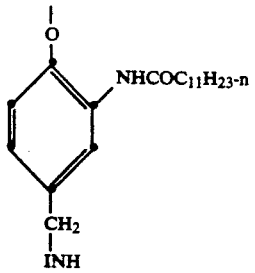

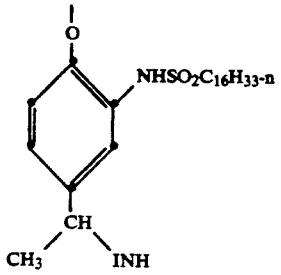

-continued

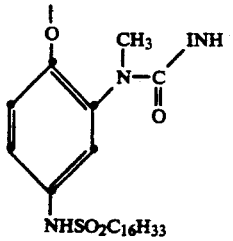

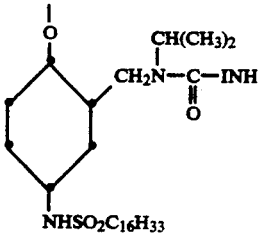

wherein $R^8$ and $R^9$ individually are unsubstituted or substituted alkyl or aryl; and INH is the mercaptotetrazole development inhibitor.

The term mercaptotetrazole group herein means any mercaptotetrazole group known in the photographic art that enables development inhibition when released and that has the described properties, particularly that enables the described Log P. Preferred mercaptotetrazole groups are described in U.S. Pat. No. 4,782,012. Other illustrative mercaptotetrazole groups include 1-phenyl-5-mercaptotetrazole (PMT) and 1-ethyl-5-mercaptotetrazole (EMT) groups.

The term "buffer" herein means an aqueous solution that contains both a weak acid and its conjugate weak base whose pH changes only slightly on addition of acid or alkali. The definition of a buffer herein is described in the chemical art, such as in *Hawley's Condensed Chemical Dictionary*, 11th Edition, N. Irving Sax and Richard Lewis, Sr.; Van Nostrand Reinhold Co., N.Y., N.Y., U.S.A., page 176.

Log P herein means the logarithm of the partition coefficient of a species between a standard organic phase, usually octanol, and an aqueous phase, usually water. The color photographic element is a polyphasic system, and the inhibitor released in such a system can partition between these phases. Log P can serve as a measure of this partitioning, and can be correlated to desirable inhibitor properties such as inhibition strength and interimage effects. Inhibitor moieties (INH) as described having Log P values of $-0.8$ to $-2.2$ have been found to be useful according to the invention. Inhibitor moieties having Log P values of $-2.5$ are too weak, while those having Log P values higher than $-0.7$ do not provide useful interimage results. In order to reproduce the conditions present in a photographic developer solution the aqueous phase selected was preferably a carbonate buffer (pH=10.0, 30.0 g $K_2CO_3$per liter).

The Log P values herein are calculated as known in the photographic art, such as described in U.S. Pat. No. 4,782,012.

The DIR couplers as described can be used for purposes and in ways in which DIR couplers have been used in the photographic art. The DIR couplers as described are useful in combination with other couplers, such as image dye-forming couplers, other DIR and DIAR couplers, competing couplers, bleach accelerator-releasing couplers, and other couplers and addenda known to be useful in the photographic art. The DIR couplers as described can be used in, for example, photographic silver halide elements designed for forming color negative images, such as photographic silver halide films, including for instance various camera films and motion-picture films, or photographic silver halide elements designed for forming reversal films, for instance reversal films that are processable in the E-6 process of Eastman Kodak Co., U.S.A.

Any image dye-forming or other couplers known to be useful in the photographic art can be used with the described DIR couplers in various locations known in the art in a photographic element. There follows a listing of patents and publications which describe representative couplers which can be useful in combination with the described DIR couplers:

A. Couplers which form cyan dyes upon reaction with oxidized color-developing agents are described in such representative patents and publications as U.S. Pat. Nos. 2,772,162; 2,895,826; 3,002,836; 3,034,892; 2,474,293; 2,423,730; 2,367,531; 3,041,236; and 4,333,999; and *Farbkuppler-eine Literaturübersicht,* published in Agfa Mitteilungen, Band III, pp 156–175 (1961).

Preferably, such couplers are phenols and naphthols which form cyan dyes on reaction with oxidized color-developing agents.

B. Couplers which form magenta dyes upon reaction with oxidized color-developing agents are described in such representative patents and publications as: U.S. Pat. Nos. 2,600,788; 2,369,489; 2,343,703; 2,311,082; 3,152,896; 3,519,429; 3,062,653; and 2,908,573; and *Farbkuppler-eine Literaturübersicht,* published in Agfa Mitteilungen, Band III, pp 126–156 (1961).

Preferably, such couplers are pyrazolones and pyrazolotriazoles which form magenta dyes upon reaction with oxidized color-developing agents.

C. Couplers which form yellow dyes upon reaction with oxidized and color-developing agents are described in such representative patents and publications as: U.S. Pat. Nos. 2,875,057; 2,407,210; 3,265,506; 2,298,443; 3,048,194; and 3,447,928; and *Farbkuppler-eine Literaturübersicht,* published in Agfa Mitteilungen, Band III, pp 112–126 (1961).

Preferably, such couplers are acyl acetamides such as benzoyl acetanilides and pivaloyl acetanilides which form yellow dyes upon reaction with oxidized color-developing agents.

D. Couplers which form colorless products upon reaction with oxidized color-developing agents are described in such representative patents as: UK Patent 861,138; U.S. Pat. Nos. 3,632,345; 3,928,041; 3,958,993; and 3,961,959.

Preferably, such couplers are cyclic carbonyl-containing compounds which form colorless products on reaction with oxidized color-developing agents.

The image dye-forming couplers can be incorporated in photographic elements and/or in photographic processing solutions, such as developer solutions, so that upon development of an exposed photographic element they will be in reactive association with oxidized color-developing agent. Coupler compounds incorporated in photographic processing solutions should be of such molecular size and configuration that they will diffuse through photographic layers with the processing solution. When incorporated in a photographic element, as a general rule, the image dye-forming couplers should be nondiffusible; that is, they should be of such molecular size and configuration that they will not significantly diffuse nor wander from the layer in which they are coated.

Photographic elements of this invention can be processed by conventional techniques in which color-forming couplers and color-developing agents are incorporated in separate processing solutions or compositions or in the element.

Photographic elements in which the couplers of this invention are incorporated can be a simple element comprising a support and a single silver halide emulsion layer or they can be multilayer, multicolor elements. The compounds of this invention can be incorporated in at least one of the silver halide emulsion layers and/or in at least one other layer, such as an adjacent layer, where they will come into reactive association with oxidized color-developing agent which has developed silver halide in the emulsion layer. The silver halide emulsion layer can contain or have associated with it other photographic coupler compounds such as dye-forming couplers, colored masking couplers and/or competing couplers. These other photographic couplers can form dyes of the same or different color and hue as the image dye-forming photographic couplers. Additionally, the silver halide emulsion layers and other layers of the photographic element can contain addenda conventionally contained in such layers.

A typical multilayer, multicolor photographic element can comprise a support having thereon a red-sensitive silver halide emulsion unit having associated therewith a cyan-dye image-providing material, a green-sensitive silver halide emulsion unit having associated therewith a magenta-dye image-providing material and a blue-sensitive silver halide emulsion unit having associated therewith a yellow-dye image-providing material, at least one of the silver halide emulsion units having associated therewith a photographic coupler as described which is capable of forming a dye capable of being washed out of the element upon exposure and processing. Each silver halide emulsion unit can be composed of one or more layers, and the various units and layers can be arranged in different locations with respect to one another.

The couplers as described can be incorporated in or associated with one or more layers or units of the photographic element. For example, a layer or unit affected by INH can be controlled by incorporating in appropriate locations in the element a scavenger layer which will confine the action of INH to the desired layer or unit. At least one of the layers of the photographic element can be, for example, a mordant layer or a barrier layer.

The light-sensitive silver halide emulsions can include coarse-, regular- or fine-grain silver halide crystals or mixtures thereof and can be comprised of such silver halides as silver chloride, silver bromide, silver bromoiodide, silver chlorobromide, silver chloroiodide, silver chlorobromoiodide and mixtures thereof. The emulsions can be negative-working or direct-positive emulsions. They can form latent images predominantly on the surface of the silver halide grains or predominantly on the interior of the silver halide grains. They can be chemically and spectrally sensitized. The emulsions typically will be gelatin emulsions, although other hydrophilic colloids are useful. Tabular-grain light-sensitive silver halides are particularly useful, such as described in *Research Disclosure*, January, 1983, Item 22534, and U.S. Pat. No. 4,434,226.

In the following discussion of suitable materials for use in the emulsions and elements of this invention, reference will be made to *Research Disclosure*, December, 1989, Item 308119, published by Kenneth Mason Publications, Ltd., Dudley Annex, 12a North Street, Emsworth, Hampshire, P010 7DQ, UK, the disclosures of which are incorporated herein by reference. This publication will be identified hereafter by the term "*Research Disclosure*".

The silver halide emulsions employed in the elements of this invention can be either negative-working or positive-working. Suitable emulsions and their preparations are described in *Research Disclosure*, sections I and II, and the publications cited therein. Suitable vehicles for the emulsion layers and other layers of elements of this invention are described in *Research Disclosure*, Section IX, and the publications cited therein.

In addition to the couplers generally described above, the elements of the invention can include additional couplers as described in *Research Disclosure*, Section VII, and the publications cited therein. These couplers can be incorporated in the elements and emulsions as described in *Research Disclosure*, Section VII, and the publications cited therein.

The photographic elements of this invention or individual layers thereof can contain brighteners (see *Research Disclosure*, Section V), antifoggants and stabilizers (see *Research Disclosure*, Section VI), antistain agents and image-dye stabilizers (see *Research Disclosure*, Section VII), light-absorbing and -scattering materials (see *Research Disclosure*, Section VIII), hardeners (see *Research Disclosure*, Section X), coating aids (see *Research Disclosure*, Section XI), plasticizers and lubricants (see *Research Disclosure*, Section XII), antistatic agents (see *Research Disclosure*, Section XIII), matting agents (see *Research Disclosure*, Section XVI) and development modifiers (see *Research Disclosure*, Section XXI).

The photographic elements can be coated on a variety of supports as described in *Research Disclosure*, Section XVII, and the references described therein.

Photographic elements can be exposed to actinic radiation, typically in the visible region of the spectrum, to form a latent image as described in *Research Disclosure*, Section XVIII, and then processed to form a visible dye image as described in *Research Disclosure*, Section XIX. Processing to form a visible dye image includes the step of contacting the element with a color-developing agent to reduce developable silver halide and oxidize the color-developing agent. Oxidized color-developing agent in turn reacts with the coupler to yield a dye.

Preferred color-developing agents useful in the invention are p-phenylenediamines. Especially preferred are 4-amino-N,N-diethylaniline hydrochloride, 4-amino-3-methyl-N,N-diethylaniline hydrochloride, 4-amino-3-methyl-N-ethyl-N-β-(methanesulfonamido)ethylaniline sulfate hydrate, 4-amino-3-methyl-N-ethyl-N-β-hydroxyethylaniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

With negative-working silver halide, the processing step described above gives a negative image. To obtain a positive (or reversal) image, this step can be preceded by development with a nonchromogenic developing agent to develop exposed silver halide, but not form dye, and then uniformly fogging the element to render unexposed silver halide developable. Alternatively, a direct-positive emulsion can be employed to obtain a positive image.

Development is typically followed by the conventional steps of bleaching, fixing or bleach-fixing to remove silver and silver halide, washing and drying.

For forming a reversal image typically development is followed by in sequence a reversal bath treatment known in the photographic art, then color development, a conditioning bath treatment, a bleach-fix treatment, and then washing and drying. Such a reversal process is, for example, the E-6 process of Eastman Kodak Co., U.S.A., described in, for instance, British Journal of Photography, 1988, pages 192–196.

The DIR acetanilide couplers as described can be prepared by the following general procedure:

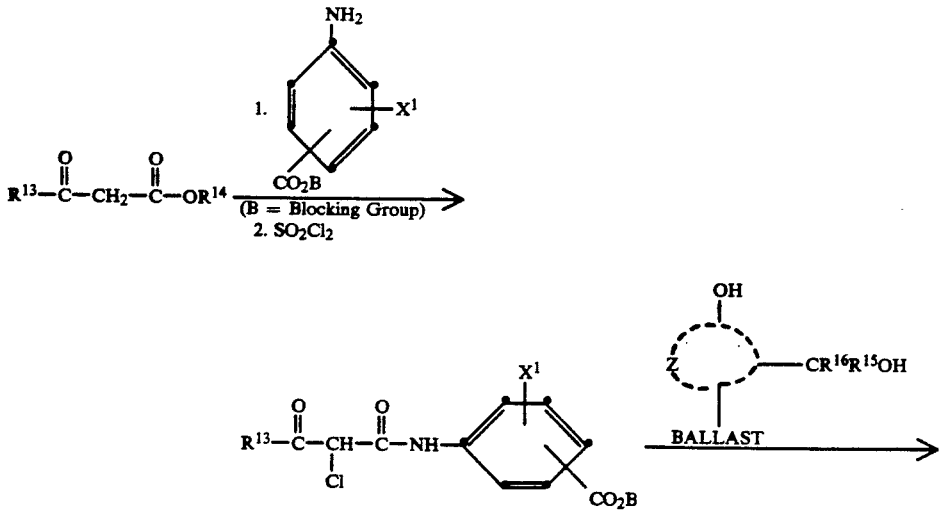

-continued

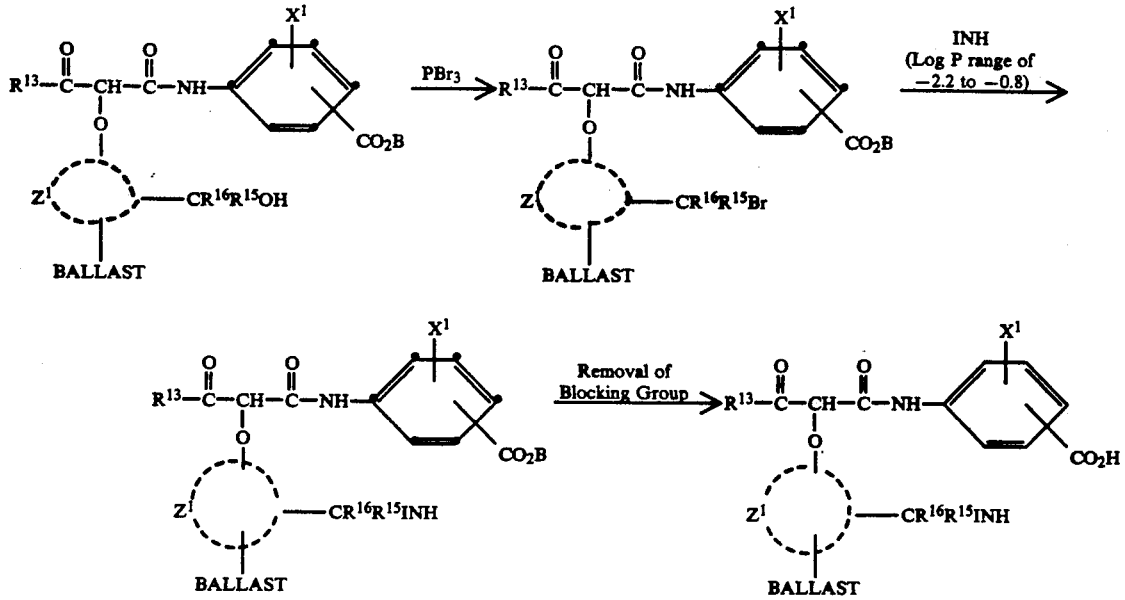

wherein:

$R^{13}$ is typically unsubstituted or substituted phenyl, such as para-methoxyphenyl; methyl, or pivalyl;

B is a blocking group, such as $CH_2CCl_3$;

$R^{14}$ is alkyl containing 1 to 4 carbon atoms, such as methyl or ethyl;

$X^1$ is hydrogen or a substituent which does not adversely affect the coupler, such as methyl, ethyl, methoxy, chlorine or bromine;

BALLAST is a ballast group known in the photographic art, as described herein;

$R^{15}$ and $R^{16}$ are individually hydrogen or an alkyl group, such as alkyl containing 1 to 4 carbon atoms, for example, methyl or ethyl;

$Z^1$ represents the atoms completing a phenyl or naphthyl group or heterocyclic group as described, which, in addition to the ballast group, is optionally substituted with a group which does not adversely affect the element or DIR coupler, such as $NO_2$;

INH is a releasable mercaptotetrazole development inhibitor group, as described.

The following synthesis example A is an illustrative method of preparing a DIR acetanilide coupler as described:

Synthesis Example A:

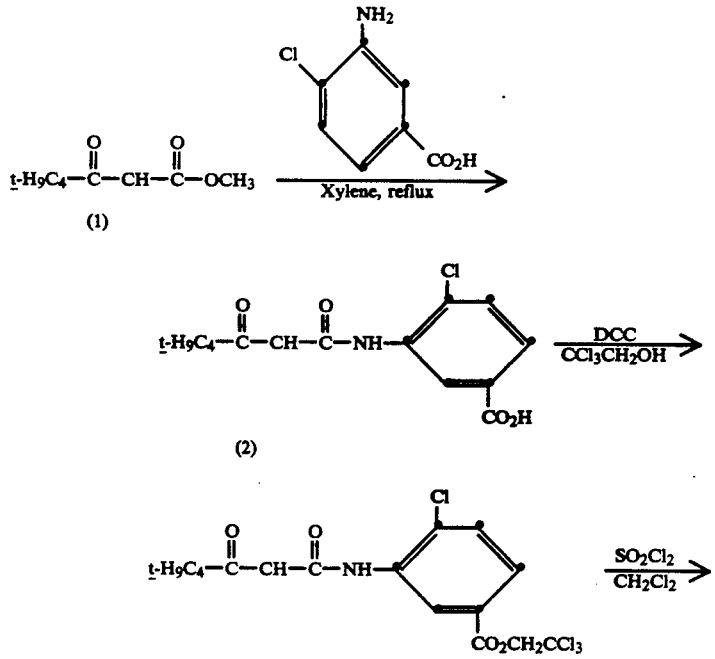

(1)

(2)

(3)

-continued
Synthesis Example A:
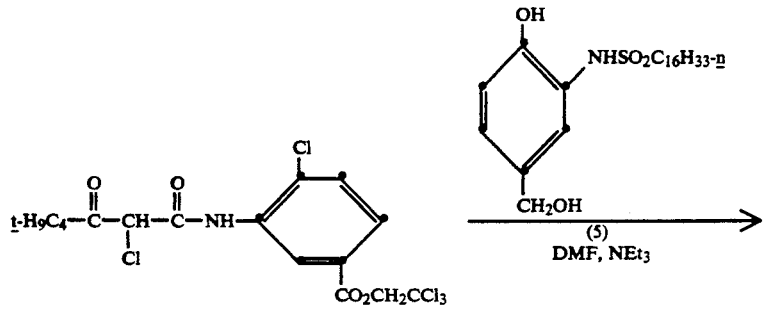
(4)
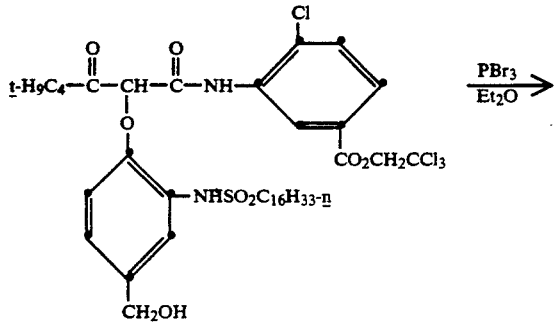
(6)
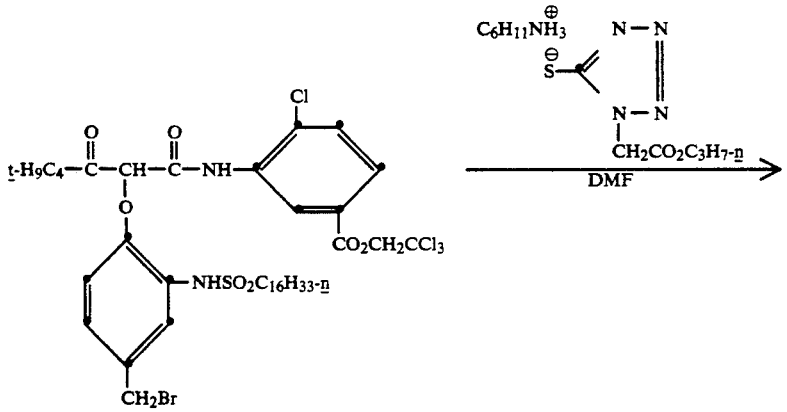
(7)
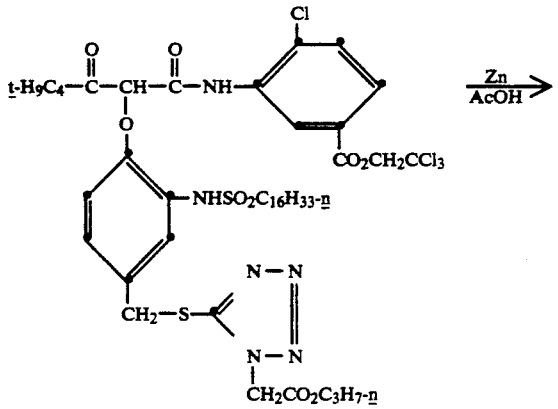
(8)

Synthesis Example A:

-continued

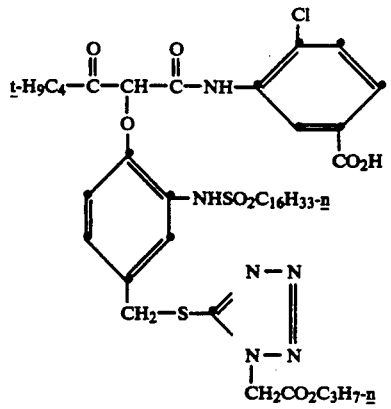

(9)

COMPOUND (2)

Methyl-4,4-dimethyl-3-oxovalerate (1) (30.0 g, 0,.19 mol) was taken up in xylene (400 mL), to which was added 3-amino-4-chlorobenzoic acid (29.6 g, 0.17 mol), and the suspension heated to reflux with a Dean-Stark apparatus in place. Complete dissolution was achieved after a few min. Xylene, in about 20-mL portions, was collected every 30 min and replaced with fresh solvent. This procedure was followed for a period of 4 hr, after which the reaction mixture was cooled to room temperature. The crystallized product was filtered off, washed with heptane and air-dried. The crude product was recrystallized from acetonitrile to yield 31.7 g (62%) of Compound (2).

COMPOUND (3)

Compound (2) (92.0 g, 0.309 mol) was dissolved in a mixture of tetrahydrofuran (800 mL) and acetonitrile (800 mL). To this solution was added 2,2,2-trichloromethanol (56.2 g, 0.376 mol) and N,N-dimethyl-4-aminopyridine (2.0 g). Dicyclohexyl carbodiimide (63.8 g, 0.309 mol) in tetrahydrofuran (100 mL) and acetonitrile (100 mL) were added dropwise to the reaction solution. At the end of the addition, the reaction was stirred at room temperature for several hr and then filtered free from dicyclohexylurea. The dichloromethane solution was washed with 2N-HCl (X1), dried ($MgSO_4$), filtered and concentrated under reduced pressure. The concentrated dichloromethane solution was then passed through a short pad of silica gel eluting with a mixture of dichloromethane, ethyl acetate and heptane in the ratio of 2:1:7. The first major band was collected to yield, after solvent removal, 103 g (78%) of product, Compound (3).

COMPOUND (4)

Compound (3) (22.0 g, 52.27 mmol) was dissolved in dichloromethane (100 mL), and sulfuryl chloride (4.32 mL, 53.83 mmol) in dichloromethane (20 mL) was added dropwise at room temperature over a 1-hr period. A t.l.c. (20% ethyl acetate in heptane) showed a new major product with still some starting material present. A further batch of the sulfuryl chloride (0.21 mL, 2.56 mmol) was added all at once and stirring continued. The total amount of sulfuryl chloride used was 4.53 mL, 56.39 mmol. The reaction was stirred at room temperature for a further 30 min to bring the reaction to completion. At the end of this period, the dichloromethane was removed under reduced pressure and the residual solid taken up in ethyl acetate with heating, cooled, and crystallization induced by the addition of some heptane. Yield of product, Compound (4), 21.4 g (90%).

COMPOUND (6)

Compound (4) (21.0 g, 45.30 mmol), together with 2-hydroxy-5-hydroxymethylbenzene hexadecylsulphonamide (16.14 g, 37.75 mmol), Compound (5), was dissolved in dimethyl formamide (100 mL) and triethylamine (25.2 mL, 181.2 mmol) added. The resulting yellow-orange solution was then stirred at room temperature for about 3 hr. At the end of this period, the reaction mixture was diluted with ethyl acetate, washed with 2N-HCl (X3), dried ($MgSO_4$), filtered, and then concentrated to an oil under reduced pressure. The residual oil was taken up in 35% ethyl acetate in heptane, and subjected to flash chromatography eluting with the same solvent mixture. The last major band was collected to yield the product, Compound (6), 14.0 g (43%).

COMPOUND (7)

Compound (6) (15.5 g, 18.13 mmol) was dissolved in dry diethyl ether (100 mL), and phosphorus tribromide (1.9 mL, 19.95 mmol) in diethyl ether (10 mL) was added dropwise with stirring. After the addition was complete, the reaction was stirred at room temperature for 15 min, then washed with 2N-HCl (X2), dried ($MGSO_4$), filtered, and the solvent removed under reduced pressure to give an oil. This oil was deemed sufficiently pure for the next step of the reaction sequence and hence was not purified any further. Yield, Compound (7), 100%.

COMPOUND (8)

Compound (7) (15.0 g, 16.34 mmol) was dissolved in dimethyl formamide (100 mi), and 2,5-dihydro-5-thioxo-1H-tetrazole-1-acetic acid, n-propyl ester, cyclohexylamine salt (5.2 g, 17.16 mmol) added. The resulting solution was stirred at room temperature for 1 hr. At the end of this period, the reaction solution was diluted with ethyl acetate, washed with 2N-HCl (X3), dried ($MgSO_4$), filtered, and the solvent removed under reduced pressure to give the crude product as an oil. This oil was dissolved in a mixture of ethyl acetate, dichloromethane and heptane in the ratio of 2:1:7 and subjected to flask chromatography eluting with the same solvent mixture. The first major band was collected to yield pure Compound (8), 15.0 g (88%).

COMPOUND (9)

Compound (8) (15.0 g, 14.44 mmol) was dissolved in glacial acetic acid (100 mL), to which was added zinc dust (10.0 g). The resulting suspension was stirred at room temperature for 20 min. At the end of this period, the excess zinc dust and the zinc salts were filtered off over celite and the filtrate concentrated under reduced pressure. The residual oil was taken up in ethyl acetate, washed with 2.5% sodium carbonate (X4), 2N, HCl (X1), dried ($MgSO_4$), filtered and concentrated to an oil under reduced pressure. This oil was dissolved in 40% ethyl acetate in heptane containing 1% acetic acid and subjected to flash chromatography eluting with the same solvent mixture. The first major band was collected, giving the product, 10.0 g (6%).

Calculated for $C_{43}H_{63}ClN_6O_9S_2$: %C, 56.92; % H, 7.00; % N, 9.26; % Cl, 3.91; % S, 7.07. Found: %C, 56.82; % H, 6.92; % N, 9.05; % Cl, 4.06; % S, 7.65.

The DIR naphtholic couplers as described can be prepared by the following general procedure:

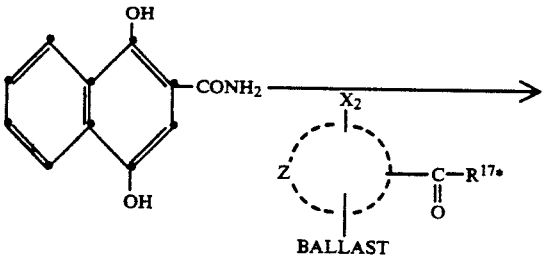

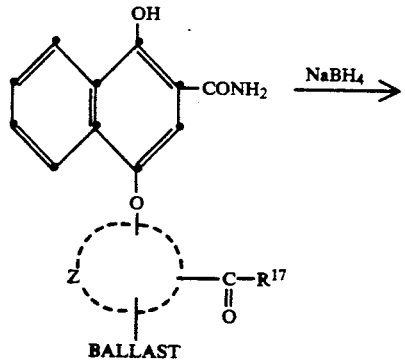

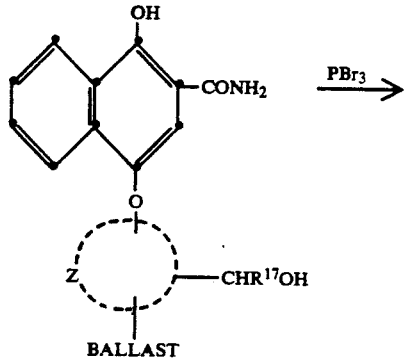

-continued

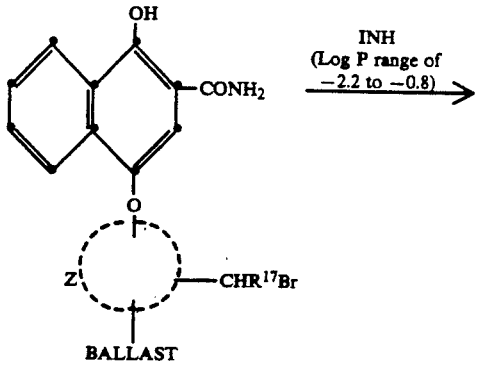

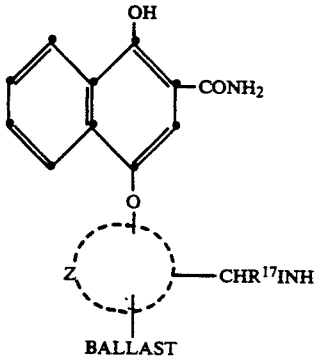

*The BALLAST can be added before or after this reaction.

The following synthesis Example B is an illustrative method of preparing a DIR naphtholic coupler, as described:

Synthesis Example B:

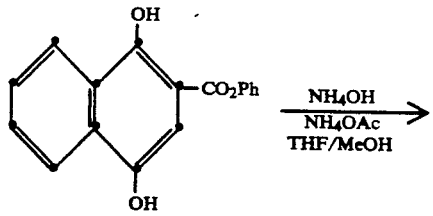

(1)

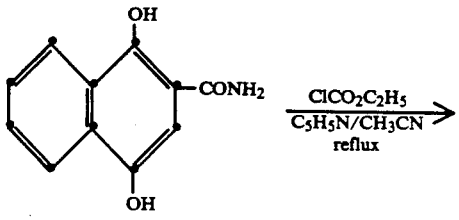

(2)

-continued
Synthesis Example B:
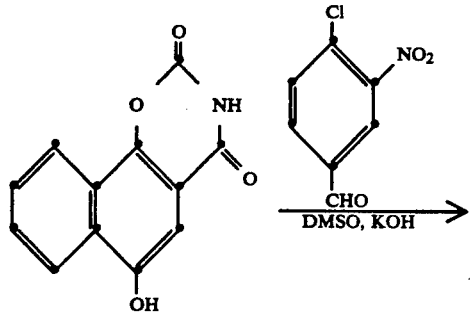
(3)
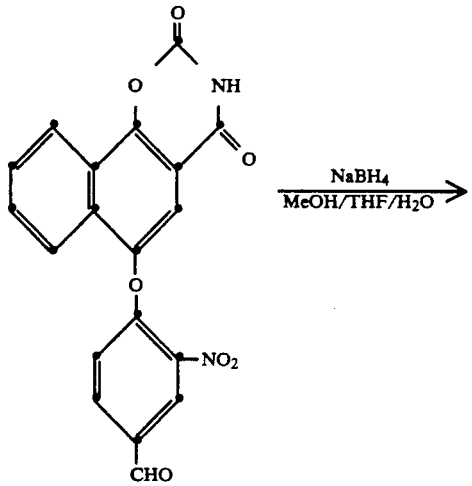
(4)
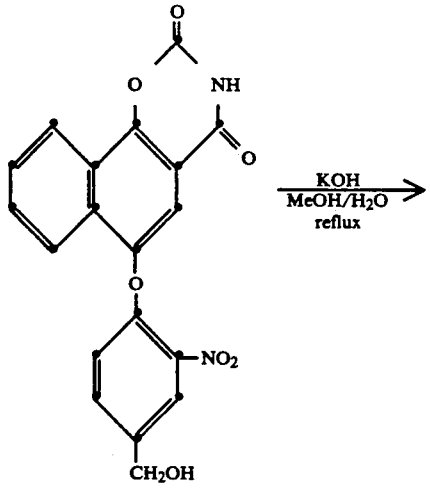
(5)
-continued
Synthesis Example B:
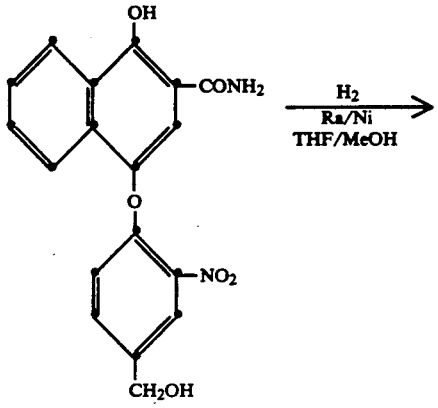
(6)
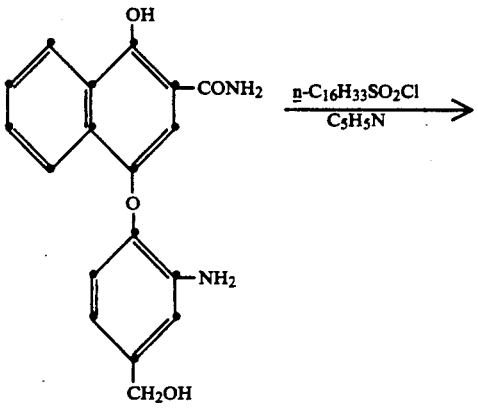
(7)
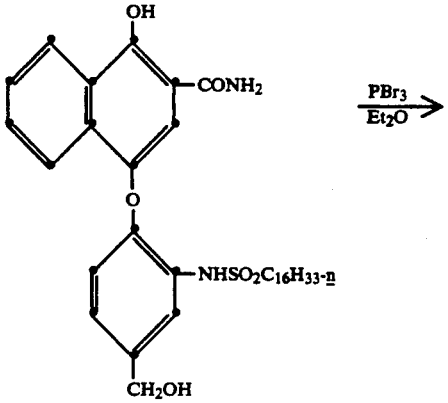
(8)

-continued

Synthesis Example B:

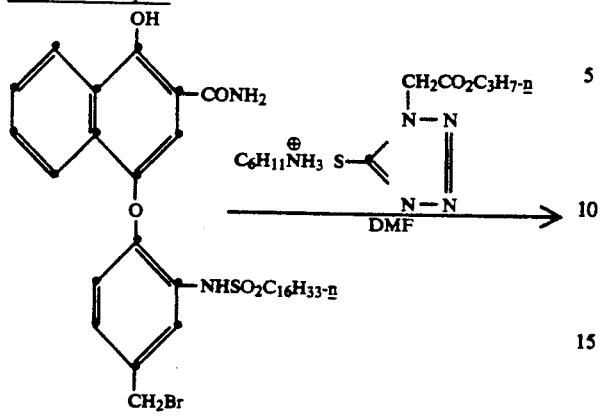

(9)

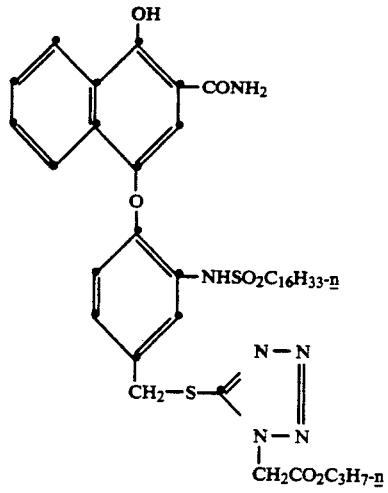

(10)

COMPOUND 2

Phenyl-1,4-dihydroxy-2-naphthoate (1) (100 g, 356.78 mmol) was dissolved in deoxygenated tetrahydrofuran (500 mL) and deoxygenated methanol (500 mL) added. To this solution, stirred at room temperature under a nitrogen atmosphere, was added ammonium acetate (50.0 g, 648.63 mmol), followed by concentrated ammonium hydroxide (1.0 L). After stirring for 3 hr, the reaction solution was then poured into ice-cold 2N-HCl (4.0 L) and enough concentrated HCl added to bring the pH to 1. The resulting product, Compound (2), was filtered off, washed well with water and air-dried. The crude product was washed with dichloromethane and air-dried again, Yield: 62.0 g (72%).

COMPOUND 3

Compound (2) (50.0 g, 0.246 mol) was dissolved in dry pyridine (150 mL) and acetonitrile (75 mL) added. The solution was stirred and cooled to −5° to 0° C. Ethyl chloroformate (50 mL, 0.523 mmol) was then added dropwise with stirring while maintaining the temperature at 0° C. After the addition, the cooling bath was removed and the temperature allowed to reach room temperature. The reaction mixture was then gradually heated to reflux and the solvent allowed to distill off. This procedure was continued until the temperature had risen to approximately 120° C. and 150 mL of solvent had been collected. Heating under reflux was continued for an additional 1-hr period. The reaction mixture was then cooled to approximately 50° C. and poured into 2N-HCl (3.0 L) held at room temperature. This suspension was then stirred for approximately 15 min, filtered, and the residue washed well with water, acetonitrile, and finally ether. This gave the product, Compound (3), sufficiently pure for the next step. Yield: 43.5 g (77%).

COMPOUND 4

Compound (3) (23.0 g, 100.35 mmol) was taken up in deoxygenated dimethyl sulfoxide (250 mL) and deoxygenated water (25 mL) added. To this solution, stirred at room temperature under nitrogen, was added 85% potassium hydroxide (9.9 g, 150.53 mmol) and stirring continued until dissolution, approximately 15 min. Then 4-chloro-3-nitrobenzaldehyde (18.62 g, 100.35 mmol) was added all at once and the resulting solution stirred at 60° C. for 1 hr. The reaction mixture was then poured into ice-cold 2N-HCl (2.0 L) and filtered off. The product, Compound (4), was washed with water and, while still wet, slurried in methanol, filtered and washed with ether. This product was pure enough to be used in the next step. Yield: 28.0 g (74%).

COMPOUND 5

Compound (4) (28.0 g, 74.01 mmol) in a powdered form was suspended in tetrahydrofuran (150 mL) and methanol (100 mL). Water (100 mL) was added, followed by sodium borohydride (2.8 g, 74.01 mmol) in small portions. More tetrahydrofuran (50 mL) was added to aid stirring. At the end of the sodium borohydride addition, complete dissolution had been achieved. The reaction was allowed to proceed for a further 15 min, then poured into ice-cold 2N-HCl (2.0 L) and the product filtered off. The product, Compound (5), was washed with methanol and, while still wet with solvent, suspended in ethanol and heated to reflux. The solution was cooled, filtered, washed with methanol, ether and finally air-dried. A second crop of material was obtained on concentrating the mother liquor. Total yield: 19.5 g (67%).

COMPOUND (6)

Compound 5 (19.0 g, 50 mmol) was suspended in water (200 mL) containing 85% potassium hydroxide (26.34 g, 400 mmol). To this mixture was added methanol (50 mL), and this was heated to 80° C. for 1 hr. The resulting dark yellow-brown solution was cooled and poured into ice-cold 2N-HCl (2.0 L). The yellow product was filtered off, washed well with water and air-dried. Yield: 17.7 g (100%).

COMPOUND (7)

Compound (6) (17.7 g, 50 mmol) was dissolved in tetrahydrofuran (80 mL) and methanol (300 mL) added. Raney-Nickel which had been washed several times with water and then methanol was added and the solution hydrogenated at 55 psi for 2 hr, after which hydrogen uptake had ceased. The catalyst was filtered off, washed with methanol, and the filtrate concentrated under reduced pressure to give the product, Compound (7). This product was deemed sufficiently pure to be carried on to the next step. Yield: 100%).

COMPOUND 8

Compound (7) (50.0 mmol) was dissolved in dry pyridine (150 mL), and hexadecylsulfonyl chloride (16.2 g, 50.0 mmol) was added. The solution was stirred at room temperature under a nitrogen atmosphere for 30 min. The pyridine was concentrated under reduced pressure and the residue taken up in ethyl acetate. This ethyl acetate solution was then washed with 2N-HCl (X3), dried ($MgSO_4$), filtered and concentrated. The resultant residue crystallized from acetonitrile. After filtering, washing with acetonitrile and drying, the yield of product, Compound (8), amounted to 16.3 g (53% calculated from Compound (6)).

COMPOUND (9)

Compound (8) (4.0 g, 6.53 mmol) was suspended in dry ether (30 mL) and phosphorous tribromide (0.68 mL, 7.18 mmol) in ether (20 mL) added dropwise over a 15-min period. After the addition, the reaction was diluted with ether and the ether solution washed with 2N-HCl (X1), dried ($MgSO_4$), filtered and concentrated to give Compound (9). The yield was 100%.

COMPOUND (10)

Compound (9) (6.53 mmol) was dissolved in dimethyl formamide (40 mL) to which was added 2,5-dihydro-5-thioxo-1H-tetrazole-1-acetic acid, n-propyl ester and triethylenediamine salt (2.26 g, 7.18 mmol), and the resulting solution was stirred at room temperature for 15 min. The reaction was diluted with ethyl acetate, washed with 2N-HCl (X1) and the emulsion which formed broken up by washing with brine (X3). The ethyl acetate layer was dried ($MgSO_4$), filtered and concentrated under reduced pressure to give an oil. This oil was taken up in a mixture of ethyl acetate, heptane and dichloromethane in the ratio of 3:10:1, respectively, and subjected to flash chromatography eluting with the same solvent mixture. The first major band was collected to give the product, Compound (10); yield, 4.2 g (81%, calculated from Compound (8)).

Calculated for $C_{40}H_{56}N_6O_7S_2$: %C, 60.28; % H, 7.08; % N, 10.54; % S, 8.05. Found: %C, 60.23; % H, 7.11; % N, 10.50; % S, 7.44.

Similar DIR couplers which can be prepared by the described methods.

Photographic elements in which the DIR compounds of this invention are incorporated are preferably multilayer, multicolor elements. The DIR compounds of this invention can release development inhibitors to enhance the effect of intralayer acutance, as well as causing interimage to other layers for acutance and color corrections of other color records. In addition to the effects mentioned above, these DIR compounds are extremely effective to make their own color record a very good receiver of the interlayer interimage effect (IIE). As a consequence of this increased ability to receive IIE, acutance and color saturation are significantly improved.

The following examples further illustrate the invention.

EXAMPLES 1-7

Example 1 (Comparison)

(A)- Comparison Photographic Element

On a cellulose triacetate film support were coated the following layers: (coverages are in grams per meter squared).

Layer 1 (Antihalation Layer)

Black colloidal silver sol containing 0.323 g/m$^2$ of silver and 2.691 g/m$^2$ gelatin.

Layer 2 (Slow Cyan Layer)

A blend of two red-sensitized silver iodobromide grains, a medium sized tabular emulsion (3.0 mole % iodide) at 1.3 g/m$^2$ and a smaller cubic emulsion (3.5 mole % iodide) at 1.1 g/m$^2$, gelatin at 3.0 g/m$^2$, cyan image-forming coupler C-1 at 0.87 g/m$^2$, DIR coupler D-1 at 0.065 g/m$^2$, bleach accelerator releasing coupler D-2 at 0.01 g/m$^2$ and antifoggant 4-hydroxy-6-methyl-1,3,3a,7-tetraazaindene at 0.036 g/m$^2$.

Layer 3 (Fast Cyan Layer)

Red-sensitized tabular silver iodobromide emulsion (6.0 mole % iodide) at 0.81 g/m$^2$, cyan dye-forming image coupler C-1 at 0.151 g/m$^2$, DIR compound D-1 at 0.065 g/m$^2$, D-3 at 0.032 g/m$^2$, gelatin at 1.68 g/m$^2$, and antifoggant 4-hydroxy-6-methyl-1,3,3a,7-tetraazaindene at 0.036 g/m$^2$.

Layer 4 (Interlayer)

Oxidized developer scavenger at 0.054 g/m$^2$ and gelatin at 1.3 g/m$^2$.

Layer 5 (Slow Magenta Layer)

Green-sensitized tabular silver iodobromide emulsion (6.0 mole % iodide) at 0.54 g/m$^2$, green-sensitized tabular emulsion (1.5 mole % iodide) at 0.26 g/m$^2$, magenta dye-forming image coupler M-1 at 0.344 g/m$^2$,DIR compound D-4 at 0.075 g/m$^2$, masking coupler M 0.108 g/m$^2$, gelatin at 1.64 g/m$^2$, and antifoggant 4-hydroxy-6-methyl-1,3,3a,7-tetraazaindene at 0.036 g/m$^2$.

Layer 6 (Fast Magenta Layer)

A blend of two green-sensitized tabular silver iodobromide grains, a fast emulsion (3.0 mole % iodide) at 0.754 g/m$^2$, a medium speed emulsion (3.0 mole % iodide) at 0.538 g/m$^2$, magenta dye-forming image coupler M-1 at 0.151 g/m$^2$, masking coupler M-2 at 0.065 g/m$^2$, gelatin at 1.40 g/m$^2$, DIR coupler D-4 at 0.043 g/m$^2$, and antifoggant 4-hydroxy-6-methyl-1,3,3a,7-tetraazaindene at 0.036 g/m$^2$.

Layer 7 (Yellow Filter Layer)

Gelatin at 0.86 g/m$^2$, Carey Lea silver at 0.043 g/m$^2$, and oxidized developer scavenger at 0.054 g/m$^2$.

Layer 8 (Slow Yellow Layer)

Blue-sensitized tabular silver iodobromide emulsion (3.0 mole % iodide) at 0.36 g/m$^2$, blue-sensitized tabular silver bromoiodide emulsion (3.0 mole % iodide) at 0.10 g/m$^2$, gelatin at 1.73 g/m$^2$, yellow dye-forming image coupler Y-1 at 0.883 g/m$^2$, DIR coupler D-5 at 0.097 g/m$^2$.

Layer 9 (Fast Yellow Layer)

Blue-sensitized tabular silver iodobromide emulsion (3.0 mole % iodide) at 0.43 g/m$^2$, gelatin at 0.807 g/m$^2$, yellow dye-forming image coupler Y-1 at 0.513 g/m$^2$, DIR coupler D-5 at 0.032 g/m$^2$.

Layer 10 (Protective Overcoast and UV Filter Layer)

Gelatin at 1.24 g/m$^2$, silver bromide Lippmann emulsion at 0.23 g/m$^2$, UV absorbers at 0.23 g/m$^2$, and bis(-vinylsulfonyl)methane added at 1.8% of total gelatin weight.

Example 2 (Invention)

A second photographic recording material, designated Example 2, was prepared in a similar manner to Example 1. The following modifications were made in the Layer 5 (Fast Magenta Layer):

The magenta DIR D-4 was replaced with 0.034 g/m$^2$ of the new DIR coupler D-A that does not form permanent dye in the film after processing.

Example 3 (Invention)

A third photographic recording material of the invention, designated Example 3, was prepared in a similar manner to Example 1. The following modifications were made in the Layer 5 (Fast Magenta Layer):

The magenta DIR D-4 was replaced with 0.039 g/m$^2$ of the new DIR coupler D-B that does not form permanent dye in the film after processing.

Example 4 (Invention)

A fourth photographic recording material of the invention, designated Example 4, was prepared in a similar manner to Example 1. The following modifications were made in the Layer 5 (Fast Magenta Layer):

The magenta DIR coupler D-4 was replaced with 0.017 g/m$^2$ of the new DIR coupler D-C that does not form permanent dye in the film after processing.

Example 5 (Invention)

A fifth photographic recording material of the invention, designated Example 5, was prepared in a similar manner to Example 1. The following modifications were made in the Layer 5 (Fast Magenta Layer):

The magenta DIR D-4 was replaced with 0.040 g/m$^2$ of the mew DIR coupler D-D that does not form permanent dye in the film after processing.

Example 6 (Invention)

A sixth photographic recording material of the invention, designated Example 6, was prepared in a similar manner to Example 1. This example was prepared for side by side comparison of Example 7. The following modifications were made in the magenta record:

Layer 4 (Slow Magenta Layer)—The magenta dye-forming coupler M-1 was replaced with 0.678 g/m$^2$ of the polymeric magenta coupler M-3.

Layer 5 (Fast Magenta Layer)—The magenta dye-forming coupler M-1 was replaced with 0.297 g/m$^2$ of the polymeric magenta coupler M-3.

Example 7 (Invention)

A seventh photographic recording material of the invention, designated Example 7, was prepared in a similar manner to Example 2. The following modifications were made in the magenta record:

Layer 4 (Slow Magenta Layer)—The magenta dye-forming coupler M-1 was replaced with 0.678 g/m$^2$ of the polymeric magenta coupler M-3.

Layer 5 (Fast Magenta Layer)—The magenta dye-forming coupler M-1 was replaced with 0.297 g/m$^2$ of the polymeric magenta coupler M-3.

The multilayer coatings as described in Examples 1–7 were exposed to actinic radiation with a step tablet. Proper filters were used so that the coatings were exposed either neutrally where all layers developed, or green separation exposure where only green layers rendered developable. The exposed film strips were processed in C-41 process of Eastman Kodak Co., U.S.A. (described in British Journal of Photography Annual 1988, pages 196–198.) and the contrast (gamma) of the film strips were measured. The gamma ratio of green of the green (separation exposure) over the green of the neutral exposure was used as a measure of the effectiveness of green record receiving interlayer interimage effect (IIE). The higher this ratio, the higher is the IIE onto green record. Acutance was also measured by exposed with fringe camera either with neutral or green separation exposure followed by processing in the described C-41 process. The AMT number of the 35mm-system integration was used as a measure of the acutance. The photographic data are summarized in TABLE I and TABLE II.

TABLE I

INTERLAYER INTERIMAGE EFFECT (IIE)

| Example | Image Cplr | DIR Cplr | Green-of -Green (gamma) | Green-of -Neutral (gamma) | Gamma Ratio G-G/G-N |
|---|---|---|---|---|---|
| 1 (Comparison) | M-1 | D-4 | 1.33 | 0.71 | 1.87 |
| 2 | M-1 | D-A | 1.76 | 0.73 | 2.41 |
| 3 | M-1 | D-B | 2.00 | 0.79 | 2.53 |
| 4 | M-1 | D-C | 1.90 | 0.75 | 2.53 |
| 5 | M-1 | D-D | 1.46 | 0.74 | 1.97 |
| 6 (Comparison) | M-3 | D-4 | 1.32 | 0.70 | 1.89 |
| 7 | M-3 | D-A | 1.76 | 0.73 | 2.41 |

TABLE II

EFFECT ON ACUTANCE

| Example | Image Cplr | DIR Cplr | Green-of -Green (AMT-35 mm) | Green-of -Neutral (AMT-35 mm) |
|---|---|---|---|---|
| 1 (Comparison) | M-1 | D-4 | 90.2 | 93.6 |
| 2 | M-1 | D-A | 91.3 | 94.7 |
| 3 | M-1 | D-B | 91.3 | 94.6 |
| 4 | M-1 | D-C | 91.1 | 95.4 |
| 5 | M-1 | D-D | 90.3 | 93.5 |
| 6 (Comparison) | M-3 | D-4 | 90.0 | 94.7 |
| 7 | M-3 | D-A | 91.1 | 95.4 |

It can be seen from the data that the DIR couplers of the invention provide improved acutance and improved interimage effects over a conventional DIR coupler.

The structures of the couplers designated in the above examples are as follows:

Y-1
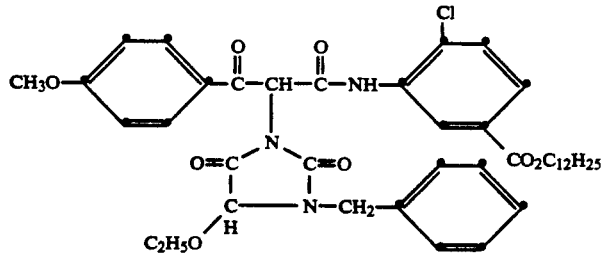
D-5
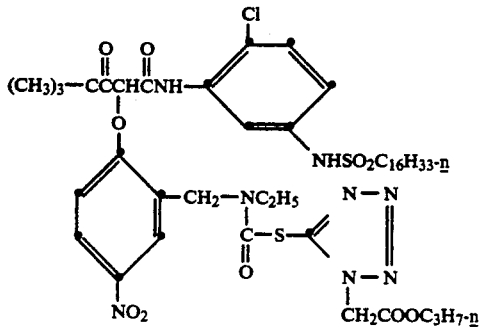
D-A
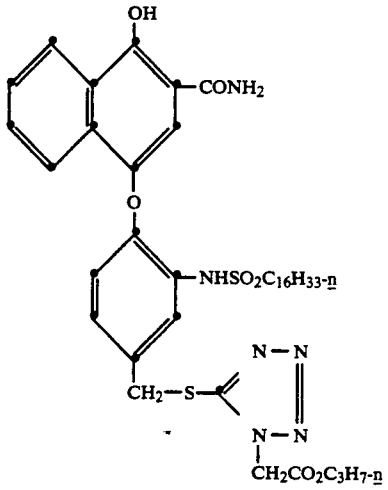
D-3
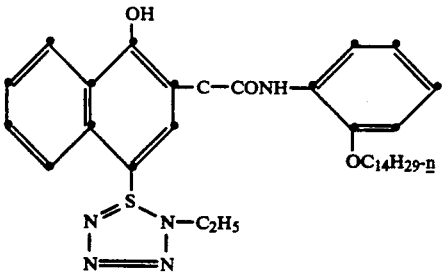
M-1
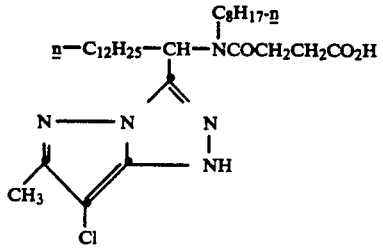

-continued
D-4
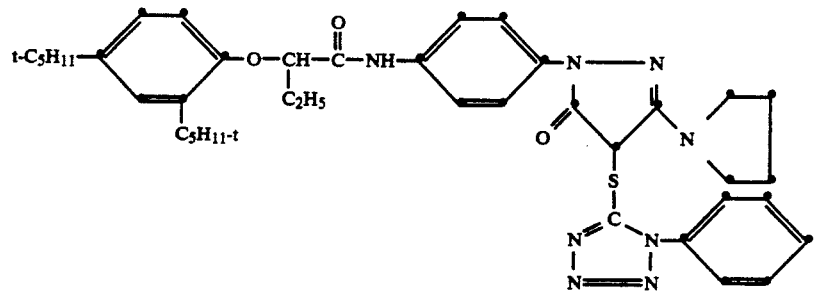
M-2
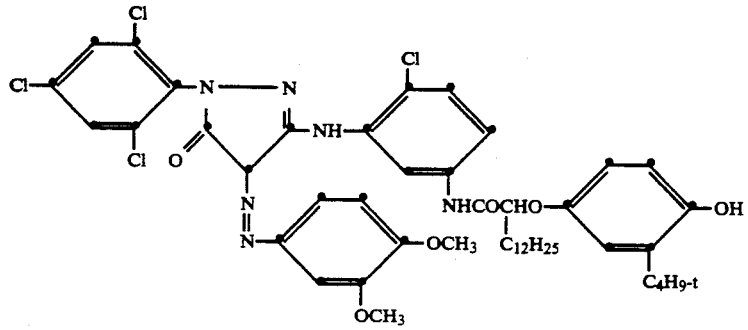
C-1
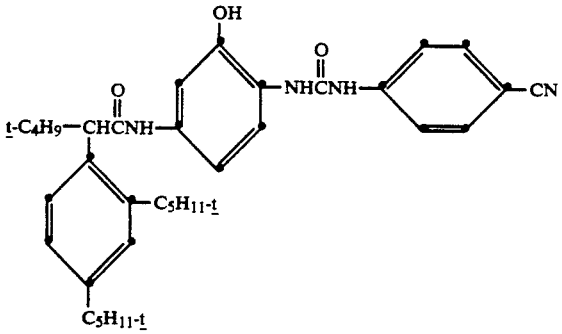
D-1
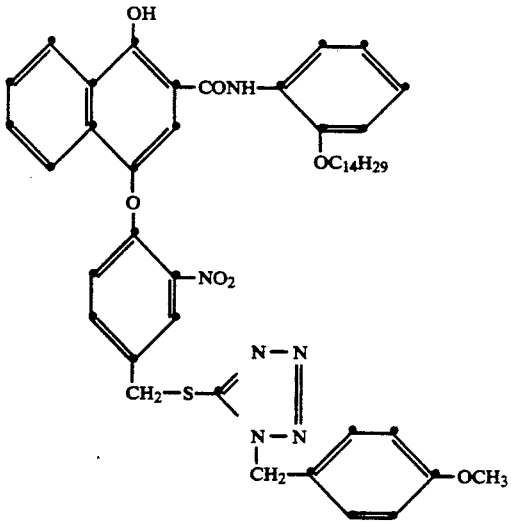

-continued
D-2
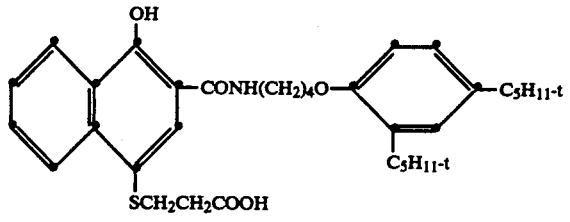
D-B
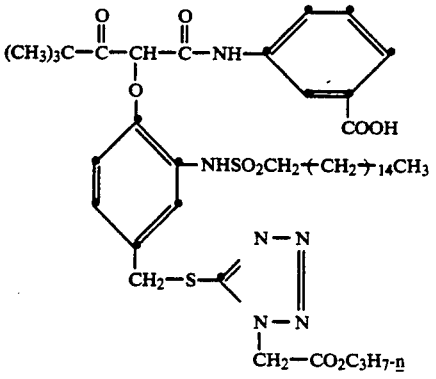
D-C
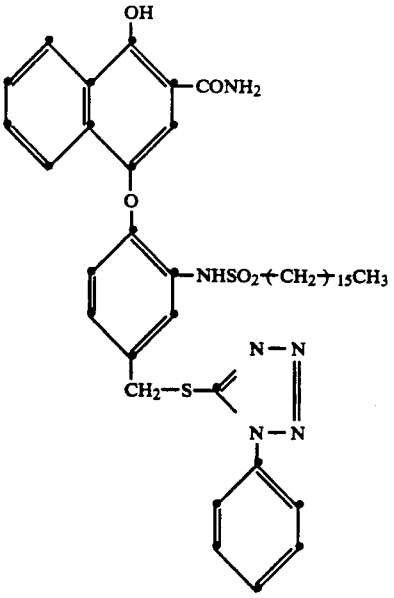

-continued
D-D
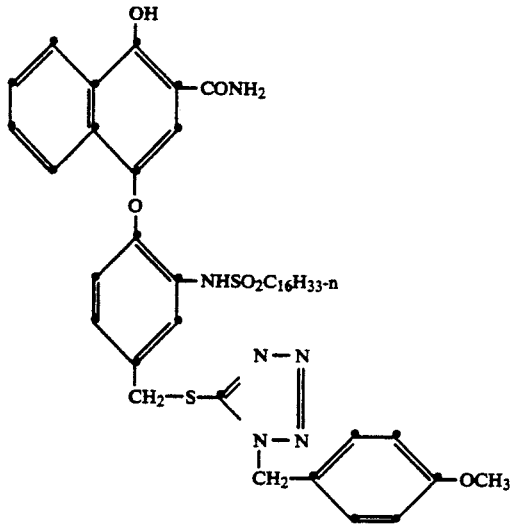
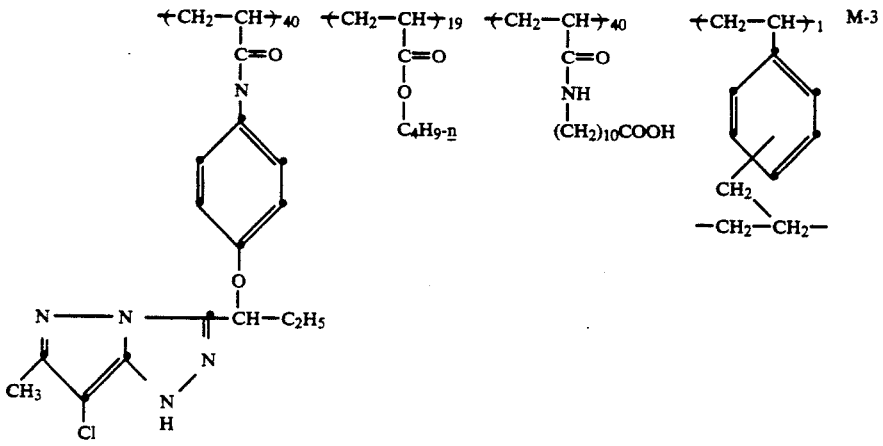
M-3
Especially useful development inhibitor releasing couplers are as follows:
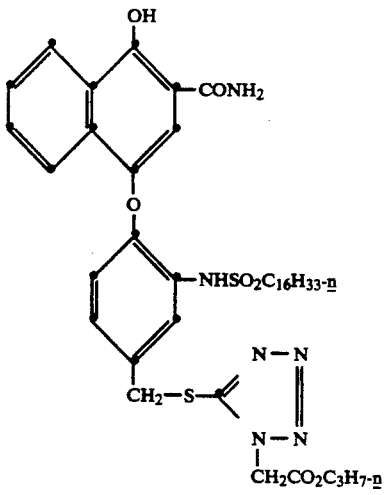
-continued
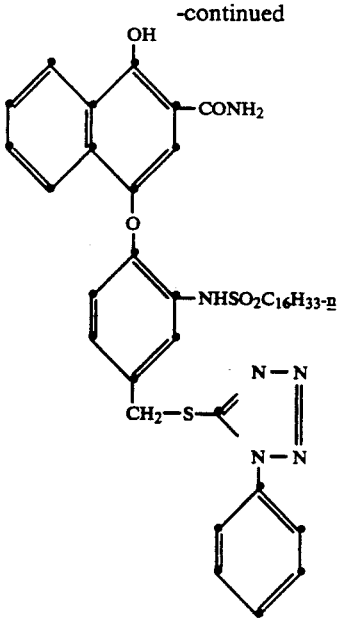

-continued

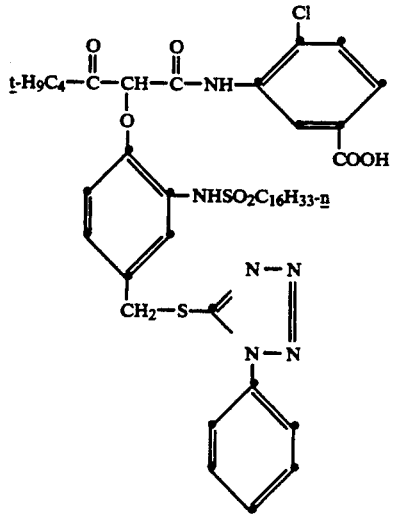

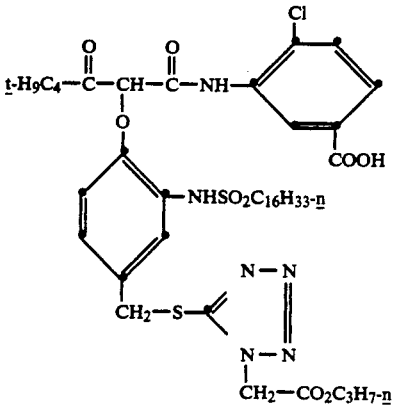

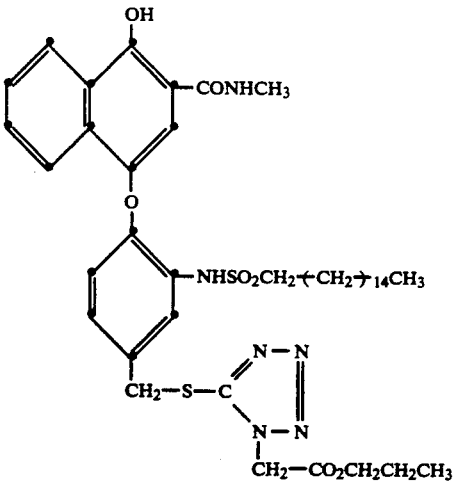

The invention has been described in detail with particular reference to preferred embodiments thereof, but it will be understood that variations and modifications can be effected within the spirit and scope of the invention.

What is claimed is:

1. A color photographic element comprising a support bearing at least one photographic silver halide emulsion layer in association with at least one development inhibitor releasing coupler having the formula $$\begin{array}{l} \text{ACOUP} \\ \text{|} \\ \text{SOL} \end{array} \quad \text{or} \quad \begin{array}{l} \text{NCOUP—L—INH} \\ \text{|} \qquad\quad \text{|} \\ \text{(CONH}_2 \quad \text{BALL} \\ \text{or} \\ \text{CONHCH}_3\text{)} \end{array}$$

wherein $$\begin{array}{l} \text{ACOUP} \\ \text{|} \\ \text{SOL} \end{array}$$

is an acetanilide dye-forming coupler moiety;

SOL is a carboxy group on the acetanilide group of the dye-forming coupler moiety;

$$\begin{array}{l} \text{NCOUP} \\ \text{|} \\ \text{(CONH}_2 \quad \text{or} \quad \text{CONHCH}_3\text{)} \end{array}$$

is a naphtholic dye-forming coupler moiety containing —$CONH_2$ or $CONHCH_3$ in the 2-position of the coupler moiety;

$$\begin{array}{l} \text{—L—} \\ \quad \text{|} \\ \quad \text{BALL} \end{array}$$

is a releasable ballasted linking group, bonded to the coupling position of $$\begin{array}{l} \text{ACOUP} \\ \text{|} \\ \text{SOL} \end{array} \quad \text{or} \quad \begin{array}{l} \text{NCOUP—L—INH} \\ \text{|} \qquad\quad \text{|} \\ \text{(CONH}_2 \quad \text{BALL} \\ \text{or} \\ \text{CONHCH}_3\text{)} \end{array}$$

BALL is a ballast group;

the coupler containing a solubilizing group that enables the coupler upon oxidative coupling to form a dye that is capable of being washed out of the element upon processing and in the coupling position a coupling-off group comprising at least one releasable mobile development inhibitor moiety (INH); wherein the development inhibitor releasing coupler is (a) an acetanilide coupler containing a carboxy group on the acetanilide moiety or (b) a naphtholic coupler containing in the 2- position a —$CONH_2$ or —$CONHCH_3$ group, said development inhibitor moiety is released from the ballasted linking group by a single intramolecular nucleophilic displacement cleavage reaction, or is released from the ballasted linking group by a single cleavage reaction wherein the ballasted linking group has the structure:

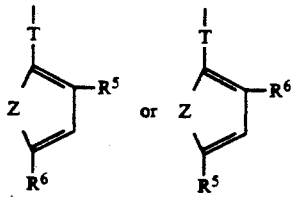

wherein $R^5$ is a ballast group;

$R^6$ is an unsubstituted or substituted methylene group bonded to the sulfur atom of the mercaptotetrazole development inhibitor group;

T is O or S; and,

Z represents the atoms completing a phenyl or naphthyl group; and contains in the coupling position a coupling-off group comprising in sequence one ballasted linking group and at least one releasable development inhibitor moiety that is a mercaptotetrazole group that enables a Log P in a pH 10 buffer of lower than −0.8.

2. A color photographic element as in claim 1 comprising a support bearing at least one photographic silver halide emulsion layer comprising a magenta dye-forming coupler represented by the formula:

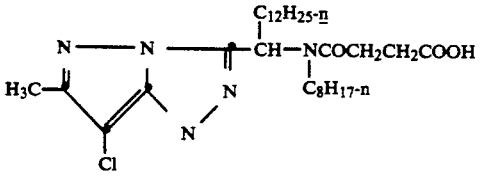

in association with a development inhibitor releasing coupler represented by the formula:

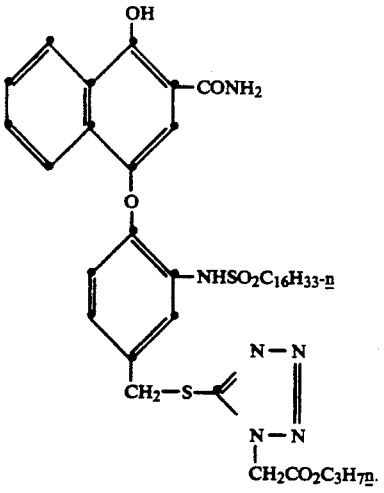

3. A color photographic element as in claim 1 wherein the mercaptotetrazole group is represented by the formula:

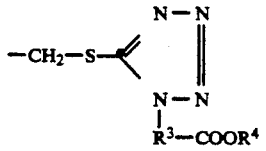

wherein $R^3$ is alkylene of 1 to 3 carbon atoms;

$R^4$ is alkyl of 1 to 4 carbon atoms; and, the sum of carbon atoms in $R^3$ and $R^4$ is 2 to 5.

4. A color photographic element as in claim 1 wherein the mercaptotetrazole group is a 1-phenyl-5-mercaptotetrazole or 1-ethyl-5-mercaptotetrazole group.

5. A color photographic element as in claim 1 wherein the coupling-off group is represented by the formula:

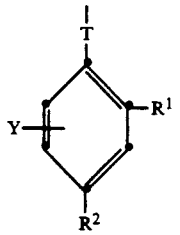

wherein

T is O or S;

$R^1$ and $R^2$ individually are a ballasting group or a mercaptotetrazole development inhibitor group represented by the formula:

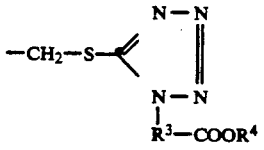

wherein $R^3$ is alkylene of 1 to 3 carbon atoms;

$R^4$ is alkyl of 1 to 4 carbon atoms;

the sum of carbon atoms in $R^3$ and $R^4$ is 2 to 5;

Y is hydrogen or a substituent group; and, one of $R^1$ and $R^2$ is a ballasting group.

6. A color photographic element as in claim 1 wherein the development inhibitor releasing coupler is

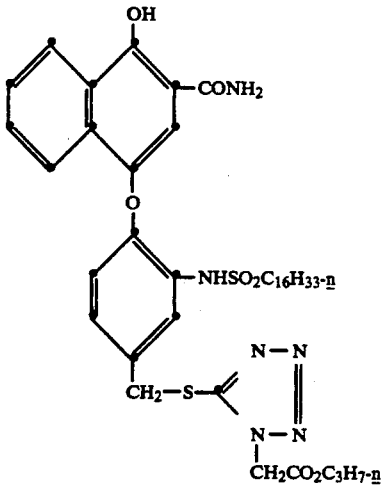

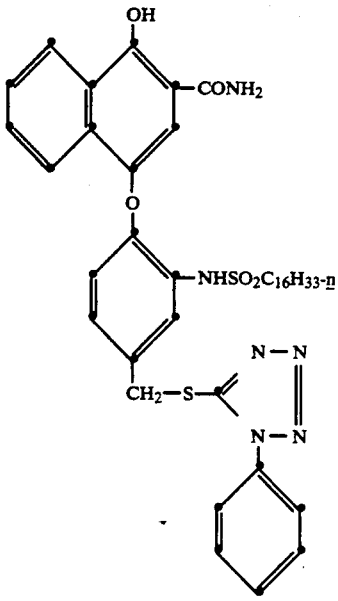

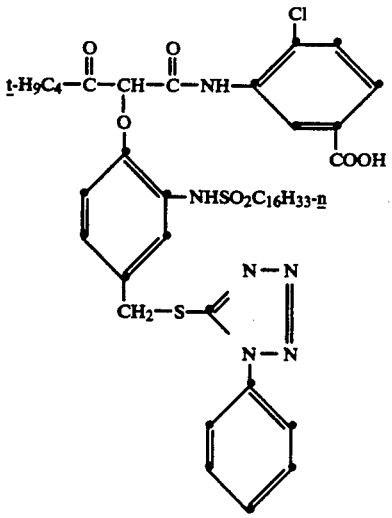

-continued

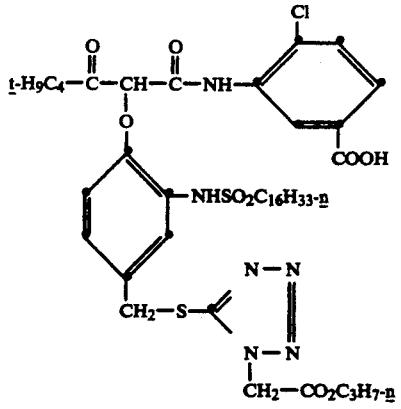

or

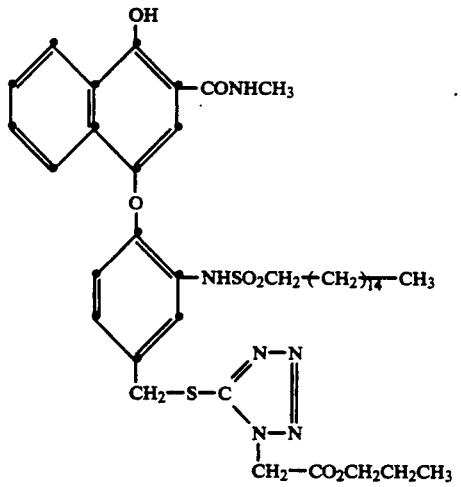

7. A color photographic element as in claim 1 wherein the development inhibitor releasing coupler is contained in one or more layers of a multilayer, multicolor photographic element.

8. A color photographic element as in claim 1 also comprising a phenolic or naphtholic cyan image dye-forming coupler, a pyrazolotriazole magenta image dye-forming coupler, and an acetanilide yellow image dye-forming coupler.

9. A color photographic element as in claim 1 comprising a photographic silver halide emulsion layer comprising a pyrazolotriazole or pyrazolone magenta dye-forming coupler, a development inhibitor releasing coupler comprising a ballasted pyrazolone coupler containing a releasable phenylmercaptotetrazole development inhibitor moiety in the coupling position, and the development inhibitor releasing coupler containing a solubilizing group.

10. A process of forming a photographic image which comprises developing an exposed photographic silver halide emulsion layer with a color developing agent in the presence of a coupler as defined in claim 1.

11. A process of forming a photographic image as in claim 10 wherein the coupler is as defined in claim 6.

12. A color photographic element comprising a support bearing at least one photographic silver halide emulsion layer in association with at least one development inhibitor releasing coupler containing a solubilizing group that enables the coupler upon oxidative coupling to form a dye that is capable of being washed out of the element upon processing and in the coupling position a coupling-off group comprising at least one releasable mobile development inhibitor moiety; wherein the development inhibitor releasing coupler is (a) an acetanilide coupler containing a carboxy group on the acetanilide moiety or (b) a naphtholic coupler containing in the 2-position a —$CONH_2$ or —$CONHCH_3$ group, said development inhibitor moiety is released from the coupling-off group by a single intramolecular nucleophilic displacement cleavage reaction, or by a single cleavage reaction through a ballasted linking group having the structure:

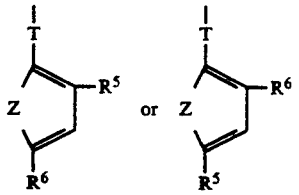

wherein $R^5$ is a ballast group;

$R^6$ is an unsubstituted or substituted methylene group bonded to the sulfur atom of the mercaptotetrazole development inhibitor group;

T is O or S; and,

Z represents the atoms completing a phenyl or naphthyl group; and contains in the coupling position a coupling-off group comprising in sequence one ballasted linking group and at least one releasable development inhibitor moiety that is a mercaptotetrazole group that enables a Log P in a pH10 buffer in the range of −0.8 to −2.2 to improve interimage effects.

* * * * *